United States Patent [19]

Tabuchi et al.

[11] Patent Number: 5,044,929

[45] Date of Patent: Sep. 3, 1991

[54] IGNITION CONTROL APPARATUS FOR PULSE COMBUSTOR

[75] Inventors: Yasuhiko Tabuchi, Sapporo; Susumi Ejiri, Toyoake; Makoto Kimura, Inazawa, all of Japan

[73] Assignee: Paloma Kogyo Kabushiki Kaisha, Nagoya, Japan

[21] Appl. No.: 406,273

[22] Filed: Sep. 12, 1989

[30] Foreign Application Priority Data

Sep. 12, 1988 [JP] Japan ..... 63-228115

[51] Int. Cl.[5] ..... F23C 11/04

[52] U.S. Cl. ..... 431/1; 431/19; 431/31

[58] Field of Search ..... 431/1, 19, 25, 27, 31

[56] References Cited

U.S. PATENT DOCUMENTS

| | | | |
|---|---|---|---|
| 4,459,099 | 7/1984 | Grunden et al. . | |
| 4,496,305 | 1/1985 | Bentz | 431/19 X |
| 4,695,246 | 9/1987 | Beifuss et al. | 431/31 |
| 4,747,771 | 5/1988 | Goodfellow et al. | 431/1 |
| 4,808,107 | 2/1989 | Yokoyama et al. | 431/1 |

*Primary Examiner*—Larry Jones

*Attorney, Agent, or Firm*—Berman, Aisenberg & Platt

[57] ABSTRACT

An ignition control apparatus for a pulse combustor, wherein the number of trials for energization of a spark electrode is calculated and memorized, the memorized number of trials is reset to an initial value or zero after ignition of the fuel-air mixture in a combustion chamber of the combustor has been successfully obtained, a period of time for pre-purge of the combustion chamber is determined in accordance with the memorized number of trials for energization of the spark electrode, and a purge blower for the combustor activated for the determined period of time prior to energization of the spark electrode to change the unburned mixture ratio to a non-combustible ratio on the trial for ignition. In the ignition control apparatus, the presence of flame in the combustion chamber is further detected for a predetermined time, and the purge blower is deactivated when a predetermined number of trials for ignition have been attempted due to lack of the presence of flame in the combustion chamber.

4 Claims, 3 Drawing Sheets

IGNITION CONTROL APPARATUS FOR PULSE COMBUSTOR

BACKGROUND OF THE INVENTION

1. Field of the Invention

The present invention relates to a pulse combustor adapted for use in liquid heating apparatuses. More particularly, the invention relates to an ignition control apparatus for the pulse combustor.

2. Description of the Prior Art

A conventional pulse combustor of this kind includes a fuel-air mixer head to be supplied with fresh air from a purge blower and gaseous fuel from a fuel supply pipe. The fuel-air mixture from the mixer head is supplied into a combustion chamber and ignited by energization of a spark electrode for a predetermined period of time. If ignition of the fuel-air mixture is not successfully obtained by the trial for ignition, a predetermined number of trials for ignition are attempted at a predetermined time interval. In general, the time interval of the trials for ignition is defined to cause change of the unburned mixture ratio to a non-combustible ratio under a forced draft of fresh air from the purge blower.

In operation of the pulse combustor, however, the supply amount of forced air from the purge blower will decrease if the air inlet of the mixer head is partly closed by foreign particles adhered thereto or the exhaust flow of combustion products is obstructed by soot collected in the exhaust passage of the combustion chamber. This results in insufficient pre-purge of the unburned mixture from an exhaust decoupler connected to the combustion chamber through a tailpipe. If the predetermined number of trials for ignition are attempted before the unburned mixture ratio is changed to a non-combustible ratio, the user will be surprised at explosive noise caused by instant combustion of the unburned mixture in the decoupler on the trial for ignition.

To solve such problems as described above, there has been proposed an ignition control apparatus for the pulse combustor wherein a pressure switch is provided to detect the supply quantity of forced air from the purge blower thereby to deactivate the pulse combustor when the supply quantity of forced air has decreased below a predetermined value. The pressure switch is, however, expensive because of high precision required thereto, resulting in an increase of manufacturing cost of the pulse combustor.

SUMMARY OF THE INVENTION

Under such prior art as described above, the present invention is directed to provide an ignition control apparatus for the pulse combustor capable of automatically controlling the time interval of the trials for ignition in accordance with the number of trials for ignition.

According to the present invention, there is provided an ignition control apparatus for a pulse combustor which includes a combustion chamber, an air-fuel mixer head mounted to an inlet of the combustion chamber, a purge blower arranged to supply forced fresh air into the mixer head for effecting pre-purge of the mixer head and combustion chamber, a fuel supply pipe connected to the mixer head to supply gaseous fuel into the mixer head, a fuel control valve provided on the fuel supply pipe to permit the supply of gaseous fuel into the mixer head when activated and to interrupt the supply of gaseous fuel when deactivated, ignition means for igniting a mixture of gaseous fuel and air supplied into the combustion chamber from the mixer head, a tailpipe connected to an exhaust port of the combustion chamber, and an exhaust decoupler connected to an exhaust end of the tailpipe, wherein the ignition control apparatus comprises means for activating the fuel control valve and for energizing the ignition means, means for calculating the number of trials for energization of the ignition means and for memorizing the calculated number of trials, means for resetting the memorized number of trials to an initial value after ignition of the mixture has been successfully obtained in the combustion chamber, means for determining a period of time for pre-purge of the mixer head and combustion chamber in accordance with the memorized number of trials for energization of the ignition means, and means for activating the purge blower for the determined period of time prior to energization of the ignition means.

Preferably, the ignition control apparatus further comprises means for detecting the presence of flame in the combustion chamber for a predetermined period of time, means for deenergizing the ignition means and deactivating the fuel control valve if the presence of flame has not been detected, means for deactivating the purge blower when a predetermined number of trials for ignition have been attempted due to lack of the presence of flame in the combustion chamber, and means for deactivating the purge blower after lapse of a predetermined period of time if the presence of flame has been detected.

BRIEF DESCRIPTION OF THE DRAWINGS

Other objects, features and advantages of the present invention will be more readily appreciated from the following detailed description of a preferred embodiment thereof when considered with reference to the accompanying drawings, in which.

DESCRIPTION OF THE PREFERRED EMBODIMENT

Figure 1:
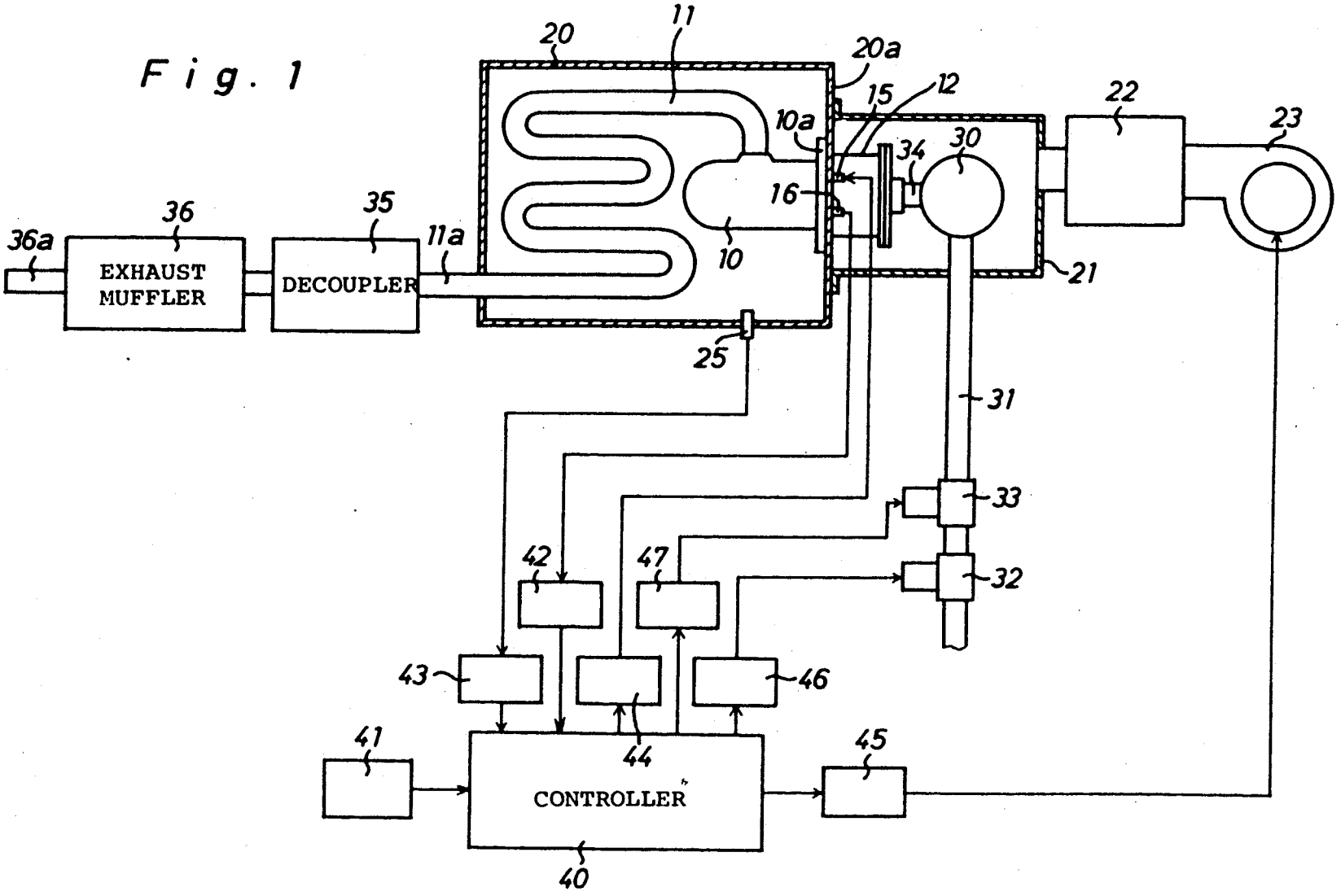
FIG. 1 is a schematic illustration of a pulse combustor provided with an ignition control apparatus according to the present invention.

As illustrated in FIG. 1, the pulse combustor includes a combustion chamber 10 and a tailpipe 11 housed within a bottom portion of a liquid vessel 20. The combustion chamber 10 is integrally formed at its inlet end with an attachment flange 10*a* which is secured to the inner surface of a forward side wall 20*a* of vessel 20 in a liquid-tight manner. The tailpipe 11 has an inner end welded to an exhaust port of the combustion chamber 10 in a liquid-tight manner and is sinuously housed in the vessel 20. The tailpipe 11 extends outwardly through a rearward side wall of vessel 20 and has an exhaust end 11*a* connected to an exhaust decoupler 35 of large capacity. The combustion chamber 10 and tailpipe 11 are arranged to be immersed in an amount of liquid stored in vessel 20. A fuel-air mixer head 12 is fixedly mounted to the attachment flange 10*a* of combustion chamber 10 through the forward side wall 20*a* of vessel 20 in an air-tight manner and is in open communication with the interior of combustion chamber 10 to supply a mixture of gaseous fuel and air thereinto. The combustion chamber 10 is provided with a spark electrode 15 and a flame detector probe 16 which are inserted into the interior of combustion chamber 10 through the attachment flange 10*a* and forward side wall 20*a*.

An air chamber causing 21 is mounted to the forward side wall 20*a* of vessel 20 to contain therein the fuel-air mixer head 12 and a gas container 30. The air chamber casing 21 is connected to an electrically operated purge blower 23 through an air intake muffler 22 to be supplied with forced fresh air therefrom. The forced fresh air from purge blower 23 is supplied into the mixer head 12 through a non-return air inlet flapper valve (not shown) provided thereon in a conventional manner. The gas container 30 has an inlet connected to a source of gaseous fuel (not shown) by means of a fuel supply pipe 31 and an outlet connected to the mixer head 12 by means of a communication pipe 34. The fuel supply pipe 31 is provided with electrically operated fuel control valves 32 and 33 for control the supply of gaseous fuel into the gas container 30. The communication pipe 34 is provided therein with a non-return gas inlet flapper valve (not shown) for permitting only the flow of gaseous fuel supplied therethrough into the mixer head 12. In this embodiment, each of the fuel control valves 32 and 33 acts to interrupt the supply of gaseous fuel into the gas container 30 when maintained in a deactivated condition.

The exhaust decoupler 35 is connected in series to an exhaust muffler 36 which has an exhaust pipe 36*a* assembled therein. In operation of the pulse combustor, the combustion products or gases are exhausted to the atmospheric air from the exhaust pipe 36*a* of muffler 36 through the decoupler 35. The decoupler 35 has an expansion chamber the capacity of which is more than 10 times the capacity of combustion chamber 10. Thus, the decoupler 35 acts to stabilize pulse combustion in the combustion chamber 10 and to absorb combustion noises applied thereto from the tailpipe 11.

An ignition control apparatus for the pulse combustor comprises a controller 40 in the form of a central processing unit which is connected to driving circuits 45, 46 and 47 for respective control of the purge blower 23 and fuel control valves 32, 33. The controller 40 is further connected to an ignition circuit 44 for energizing the spark electrode 15 and to an operation unit 41 including an operation switch (not shown) and a set switch for setting a desired temperature of liquid in vessel 20, a flame detection circuit 42 responsive to an electric signal from probe 16 for detecting the presence of flame in combustion chamber 10, and a temperature detection circuit 43 responsive to an electric signal from a thermister 25 mounted to the vessel 20 for detecting a temperature of the liquid. The controller 40 is activated by a command signal applied thereto from the operation switch of unit 41 to control the purge blower 23, fuel control valves 32, 33 and spark electrode 23 as will be described in detail hereinafter with reference to the flow chart of FIGS. 2 and 3.

Figure 2:
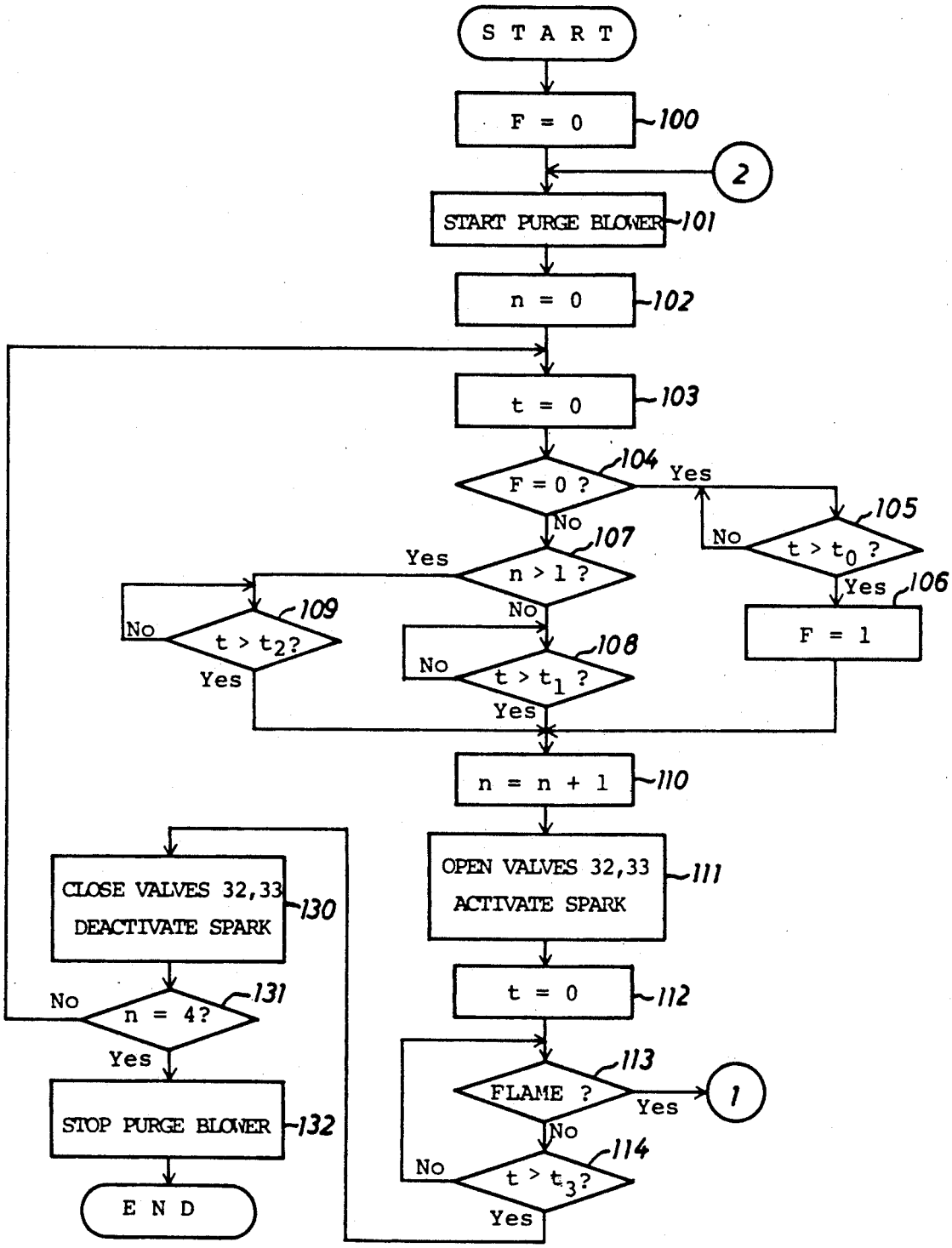
FIGS. 2 and 3 illustrate a flow chart of a control program executed by a controller of the ignition control apparatus.
Figure 3:
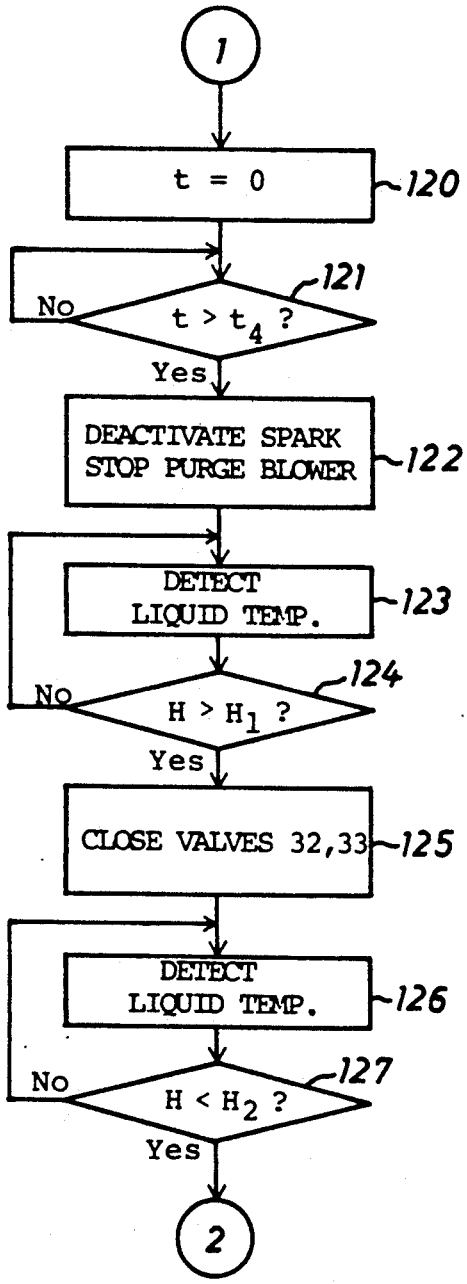

When activated by a command signal from the operation unit 41, the controller 40 acts to reset respective variables of detection elements 16, 25 as an initial value or zero and to set a flag F as F=0 at step 100 in the control program shown by the flow chart of FIGS. 2 and 3. At the following step 101, the controller 40 activates the driving circuit 45 to operate the purge blower 23. Thus, pre-purge of air and gases from the mixer head 12 and combustion chamber 10 is effected by a forced draft of fresh air from the purge blower 23. Subsequently, the controller 40 resets at step 102 a value n indicative of the number of trials for ignition as n=0 and resets at step 103 a timer as t=0 to measure lapse of a time t. When the program proceeds to step 104, the controller 40 determines as to whether the flag F is "0" or not. As a "Yes" answer is determined at the this stage, the program proceeds to step 105 where the controller 40 maintains the activation of driving circuit 45 for a predetermined period of time $t_0$ (for instance, 80 seconds) to effect pre-purge of the mixer head 12 and combustion chamber 10. When the program proceeds to step 106, the controller 40 sets the flag F as F=1 and causes the program to proceed to step 110 where the controller 40 adds "1" to the value n.

Subsequently, the program proceeds to step 111 where the controller 40 activates the driving circuits 46 and 47 to open the fuel control valves 32 and 33 and activates the ignition circuit 44 to energize the spark electrode 15. At the following step 112, the controller 40 resets the timer as t=0 to restart measurement of the time t and causes the program to proceed to step 113. Thus, the gaseous fuel from pipe 31 is supplied into the mixer head 12 through the gas container 30 and mixed with the forced fresh air from purge blower 23 in the mixer head 12. Then, the fuel-air mixture from mixer head 12 is supplied into the combustion chamber 31 and ignited by energization of the spark electrode 15.

If ignition is successfully obtained on this trial for ignition, the decoupler 35 coacts with the tailpipe 11 to establish a resonance therein thereby to effect pulse combustion in the combustion chamber 31 in a well known manner, and the presence of flame in combustion chamber 31 is detected by the flame detector probe 16. In this instance, the controller 40 is applied with an electric signal indicative of the presence of flame from the flame detection circuit 43 to determine a "Yes" answer at step 113 and causes the program to proceed to step 120 shown in FIG. 3. If ignition is not successfully obtained on the trial for ignition, flame in combustion chamber 31 is not detected by the flame detector probe, 16. In this instance, the controller 40 determines a "No" answer at step 113 due to lack of the electric signal from the flame detection circuit 43. At the following step 114, the controller 40 calculates lapse of a predetermined time $t_3$ (for instance, 5 seconds) to repeat the detection of flame at step 113. If the controller 40 determines a "yes" answer at step 114 after lapse of the time $t_3$, the program will proceed to step 130.

Assuming that the presence of flame in the combustion chamber 31 has been detected by the flame detector probe 16, the controller 40 resets the timer as t=0 at step 120 to restart measurement of the time t and causes the program to proceed to step 121. Then, the controller 40 calculates at step 121 lapse of a predetermined period of time $t_4$ (for instance, 5 seconds). When the controller 40 determines a "Yes" answer at step 121 after lapse of the time $t_4$, the program proceeds to step 122 where the controller 40 deactivates the driving circuits 44 and 45 to deenerize the spark electrode 15 and to stop the operation of purge blower 23. At this stage, the pulse combustion will be stabilized without the need for energization of the spark electrode 15 to heat liquid stored in the vessel 20. Subsequently, the controller 40 is applied at step 123 with an electric signal indicative of liquid temperature H in the vessel from the temperature detection circuit 43 and determines at step 124 as to whether or not the liquid temperature H has become higher than a desired temperature $H_1$ previously defined by the set switch of operation unit 41. When the liquid temperature H exceeds the desired temperature $H_1$, the controller 40 deactivates the driving circuits 46, 47 at step 125 to close the fuel control valve 32, 33 to deactivate the pulse combustor.

At the following steps 126 and 127, the controller 40 detects the liquid temperature H in the same manner as described above and determines as to whether or not the liquid temperature H has become lower than a predetermined lower limit value $H_2$ defined by the set switch of operation unit 41. When the liquid temperature H drops below the lower limit value $H_2$, the program returns to step 101 where the controller 40 restarts to execute the program of steps 101 to 122. In such a continuous execution, the program proceeds to step 107 from step 104 since the flag F is previously set as F=1. At step 107, the controller 40 determines as to whether or not the number n of trials for ignition is more than "1". If a "Yes" answer is determined, the program will proceed to step 109 where the controller 40 activates the driving circuit 45 for a predetermined period of time $t_2$ (for instance, 15 seconds) to effect pre-purge of the mixer head 12 and combustion chamber 31 and causes the program to proceed to step 110. If a "No" answer is determined at step 107, the program will proceed to step 108 where the controller 40 activates the driving circuit 45 for a predetermined period of time $t_1$ (for instance, 5 seconds) to effect pre-purge of the mixer head 12 and combustion chamber 31.

Assuming that the presence of flame in the combustion chamber 31 has not been detected at step 113 of the program, the controller 40 deactivates at step 130 the driving circuit 44, 46, 47 to deenergize the spark electrode 15 and to close the fuel control valves 32, 33. At the following step 131, the controller 40 determines as to whether or not the number n of trials for ignition is "4". When the number n of trials for ignition is less than "4", the program returns to step 103 where the controller 40 restarts to execute the program of steps 103 to 113. If in such a continuous execution the presence of flame is not detected at step 113, the number n of trials for ignition increases by "1" added thereto in each execution at step 110, and the time $t_1$ for pre-purge is changed to the time $t_2$ longer than the time $t_1$. When the number n of trials for ignition becomes "4", the program proceeds to step 132 where the controller 40 deactivates the driving circuit 45 to stop the purge blower 23 and applies an alarm signal to an appropriate warning device such as a buzzer or lamp adapted thereto. From the above description, it will be understood that the time for pre-purge is prolonged to $t_2$ from $t_1$ when the trials for ignition have been failed two times and that the pulse combustor is deactivated when the trials for ignition have been failed four times.

In operation of the pulse combustor, the supply amount of forced air from the purge blower 23 will decrease if the air inlet of the mixer head 12 is partly closed by foreign particles adhered thereto or the exhaust flow of combustion products is obstructed by soot collected in the exhaust passage of the combustion chamber 31. If in such a condition ignition is not successfully obtained, the time interval of the trials for ignition is prolonged in accordance with the number of trials for ignition. This is effective to change the unburned mixture ratio to a non-combustible ratio under a forced draft of fresh air from the purge blower 23.

Although the preferred embodiment of the present invention has been shown and described, it should be understood that various modifications and rearrangements of the control program may be resorted to without departing from the scope of the invention as disclosed and claimed herein

What is claimed is:

1. An ignition control apparatus for a pulse combustor including a combustion chamber, an air-fuel mixer head mounted to an inlet of said combustion chamber, a purge blower arranged to supply forced fresh air into said mixer head for effecting pre-purge of said mixer head and combustion chamber, a fuel supply pipe connected to said mixer head to supply gaseous fuel into said mixer head, a fuel control valve provided on said fuel supply pipe to permit the supply of gaseous fuel into said mixer head when activated and to interrupt the supply of gaseous fuel when deactivated, ignition means for igniting a mixture of gaseous fuel and air supplied into said combustion chamber from said mixer head, a tailpipe connected to an exhaust port of said combustion chamber, and an exhaust decoupler connected to an exhaust end of said tailpipe, the ignition control apparatus comprising:

means for activating said fuel control valve and for energizing said ignition means;

means for calculating the number of trials for energization of said ignition means and for memorizing the calculated number of trials;

means for resetting the memorized number of trials to an initial value after ignition of the mixture has been successfully obtained in said combustion chamber;

means for changing a period of time for pre-purge of said mixer head and combustion chamber according to a predetermined memorized number of trials for energization of said ignition means; and means for activating said purge blower for the determined period of time prior to energization of said ignition means.

2. An ignition control apparatus as claimed in claim 1, further comprising means for detecting the presence of flame in said combustion chamber for a predetermined time, means for deenergizing said ignition means and deactivating said fuel control valve if the presence of flame has not been detected.

3. An ignition control apparatus as claimed in claim 2, further comprising means for deactivating said purge blower after lapse of a predetermined period of time if the presence of flame has been detected.

4. An ignition control apparatus as claimed in claim 2, further comprising means for deactivating said purge blower when a predetermined number of trials for ignition have been attempted due to lack of the presence of flame in said combustion chamber.

* * * * *